US005633473A

United States Patent [19]

Mori et al.

[11] Patent Number: 5,633,473

[45] Date of Patent: May 27, 1997

[54] ELECTRONIC MUSICAL INSTRUMENT

[75] Inventors: Yasuhiko Mori; Yoshihiro Suzuki; Iwao Hamaura, all of Tokyo, Japan

[73] Assignee: Korg Incorporated, Tokyo, Japan

[21] Appl. No.: 357,765

[22] Filed: Dec. 16, 1994

Related U.S. Application Data

[63] Continuation of Ser. No. 79,777, Jun. 22, 1993, abandoned.

[30] Foreign Application Priority Data

| | | | |
|---|---|---|---|
| Jun. 26, 1992 | [JP] | Japan | 4-169417 |
| Sep. 16, 1992 | [JP] | Japan | 4-246804 |
| Mar. 19, 1993 | [JP] | Japan | 5-060332 |

[51] Int. Cl.[6] ..... G10H 3/14; G10H 3/26; G10H 7/00

[52] U.S. Cl. ..... 84/625; 84/735; 84/738; 84/DIG. 10; 84/DIG. 12

[58] Field of Search ..... 84/622–625, 627, 84/659–661, 663, 692–700, 702, 703, 735, 736, 738, DIG. 9, DIG. 10, DIG. 12

[56] References Cited

U.S. PATENT DOCUMENTS

| | | | |
|---|---|---|---|
| 4,372,187 | 2/1983 | Berg | 84/702 X |
| 4,899,633 | 2/1990 | Lombardi | 84/DIG. 12 |
| 5,212,334 | 5/1993 | Smith, III | 84/DIG. 9 |
| 5,223,657 | 6/1993 | Takeuchi | 84/DIG. 10 |
| 5,286,913 | 2/1994 | Higashi | 84/659 X |

*Primary Examiner*—Stanley J. Witkowski
*Attorney, Agent, or Firm*—Pollock, Vande, Sande & Priddy

[57] ABSTRACT

The vibration of a vibratory element, caused by applying thereto a shock, is detected by a vibration sensor and provided as an electric shock signal to a resonance circuit. The resonance frequencies and resonance decay time of the resonance circuit can freely be adjusted. By setting the resonance frequencies and resonance decay time of the resonance circuit to arbitrary values, desired frequency components are extracted from the electric shock signal and output as a sound signal of an electronic musical instrument.

20 Claims, 15 Drawing Sheets

ELECTRONIC MUSICAL INSTRUMENT

This application is a continuation of U.S. patent application Ser. No. 08/079,777, filed Jun. 22, 1993, now abandoned.

BACKGROUND OF THE INVENTION

The present invention relates to an electronic musical instrument which is used to play a variety of music.

Musical instruments are roughly divided into an acoustic and an electric or electronic musical instrument according to the tone production system used. The acoustic musical instrument is one that uses natural mechanical vibrators as sound sources whereas the electric or electronic musical instrument is one that uses, as sound sources, oscillators formed by electric circuits or prestores musical waveforms in a memory and reads out therefrom the musical waveforms to generate musical signals.

Incidentally, there is a musical instrument of the type that attaches a pickup to an acoustic musical instrument and electrically amplifies its sound for reproduction through a loudspeaker system, and this type of musical instrument is considered as a kind of acoustic instrument.

In electronic musical instruments sound sources are formed by electric circuits and musical sounds or tones are output as electric signals. On this account, arbitrary waveforms can be generated by a waveform shaping circuit or the like and thus the electronic musical instrument has an advantage that it is able to synthesize sounds or tones having a great variety of timbres or tone colors.

In the ability to express player's feelings, however, the electronic musical instrument is inferior to the acoustic musical instrument. That is, the acoustic musical instrument permits the expression of player's feelings in accordance with his way of playing the instrument, whereas the electronic musical instrument, for example, a keyboard instrument, produces a sound of a pitch corresponding to the key depressed but its timbre always remains unchanged regardless of the force applied to the key, and thus the electronic musical instrument lacks the power of expression of feelings.

FIG. 1 shows, by way of example, a conventional electronic percussion instrument. A description will be given of the reason for which it is poor in the expression of feelings. Reference numeral 1 denotes a pad. The pad 1 is formed, for instance, by stretching tight a skin or a sheet of synthetic resin over a frame and has a vibro-electric converting sensor 2, such as a piezoelectric or pressure-sensitive element, attached to the back of the hide or the sheet to convert an impulse applied to the pad 1 into an electric impulse signal. An impulse waveform signal 3 from the sensor 2 is applied to an envelope detector 4, from which a trigger signal 5 is obtained.

The trigger signal 5 is input into, for example, a processor 6 called CPU, which reads out tone color data written in a specified address area of a read-only memory (hereinafter referred to as a ROM) 7. In the ROM 7 there are prestored sound data of various percussion instruments, and by reading out a specified piece of data from the ROM 7 and converting it by a D-A converter 8 into an analog signal, an electric impulse signal corresponding to the sound of a selected percussion instrument can be provided at an output terminal 11. The electric impulse signal thus obtained is applied to an amplifier/speaker system 12 for producing the sound of the selected percussion instrument through a speaker 12A. The sound data of various percussion instruments written in the ROM 7 is selected on the basis of a set value set in a setting part 13 provided in association with the CPU 6 and thus the sound data of an arbitrary percussion instrument is selectively read out of the ROM 7.

Reference numeral 9 denotes a variable gain amplifier, the gain of which is controlled by the CPU 6 in accordance with the magnitude of the peak value of the trigger signal 5 available from the envelope detector 4. That is, the gain of the variable gain amplifier 9 is controlled according to the force with which the pad 1 was struck, and consequently, the loudness of the sound can be reproduced in accordance with the force with which the pad 1 was struck.

With the conventional percussion instrument, pieces of waveform data of sounds of various percussion instruments are prestored in the ROM 7, from which a waveform data of the percussion sound selected by a player at the start or in the course of playing is read out from the ROM 7 in synchronization with his pad striking action to generate the sound. Since the timbre or tone color thus reproduced is determined by the data written in the ROM 7 regardless of the tone color which is produced by striking the pad 1, it is impossible to express the tone color intended by the player. On the other hand, in the case of the acoustic instrument, it is possible to change the tone color and the attenuation time (or attenuation rate) by changing the striking position of the pad 1, changing the material of an object for striking the pad 1, or striking the pad 1 while at the same time pressing it with a hand. Thus, a proper combination of them will permit the expression of various tone colors even with the same percussion instrument. However, the conventional electronic percussion instrument shown in FIG. 1 does not have such a function and produces only monotonous or superficial sounds set in the setting part 13. This defect is common to all electronic musical instruments.

SUMMARY OF THE INVENTION

It is therefore an object of the present invention to provide an electronic musical instrument which enables its player to express his feelings by the same playing techniques as those for acoustic instruments.

According to the present invention, a signal source is made up of a natural mechanical vibratory element which can be vibrated by an impulsive shock or percussion and a vibration sensor which detects the vibration of the vibratory element and converts it into an electric impulse signal, and the vibratory element is given a shock, by which an electric impulse signal is provided from the signal source. A signal of a desired frequency component is extracted by a resonance circuit from the electric impulse signal and the signal thus extracted is output as a sound signal of the electronic musical instrument. The vibratory element may be formed by any of a block or chip of wood and a piece of metal which perform damped oscillation when struck, tense sheets of various materials and a tense string which causes damped oscillation when twanged.

When the vibratory element is vibrated by an impulse shock, the vibration is not ever at a single frequency but contains many frequency components over a wide frequency band. According to the present invention, the level, duration and frequency spectrum of the electric impulse signal which is provided from the signal source vary with the strength of shock given to the vibratory element and the manner in which it was given, and in the case where the sound signal of the electronic musical instrument provided from the resonance circuit is output after being converted to a sound, the timbre of the sound is greatly influenced by the characteristic of the resonance circuit and, at the same time, varies with the manner how the player strikes the vibratory element and the area of the vibratory element where it is struck, and thus the musical sound can be produced with expression of timbre as well as loudness. In the case of forming a drum or similar percussion instrument as the vibratory element, its vibration caused by striking it contains frequency components over a wide frequency band, and since the spectrum of the vibration undergoes a substantial change with a change in the position of striking the vibratory element and a change in the material of the striker, the timbre and volume of the musical sound can be changed. Furthermore, by striking the vibratory element while touching it with a hand, the damping time of the vibration can be changed, and hence a sound intended by the player can be produced. Besides, the average or mean interval of the impulse sound can be determined by the resource frequency set in the resonance circuit, irrespective of the average or mean interval of the impulsive vibration of the vibratory element.

DESCRIPTION OF THE PREFERRED EMBODIMENTS

Figure 1:
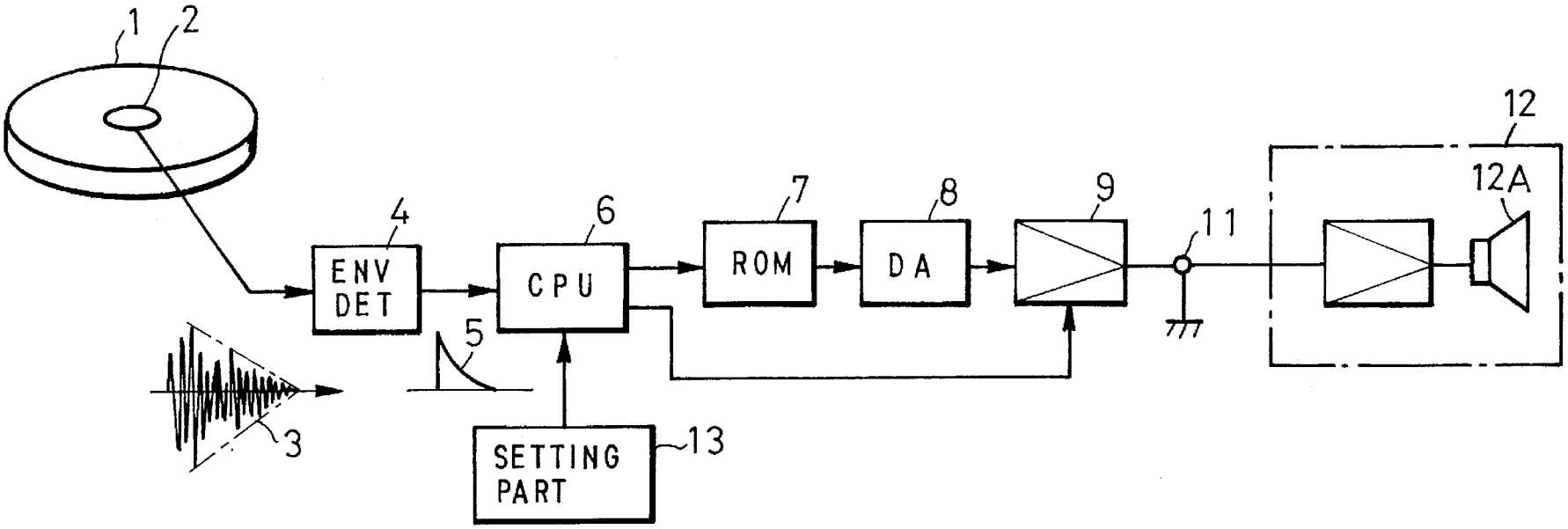
FIG. 1 PRIOR ART
FIG. 1 is a block diagram for explaining a conventional electronic musical instrument.
Figure 2:
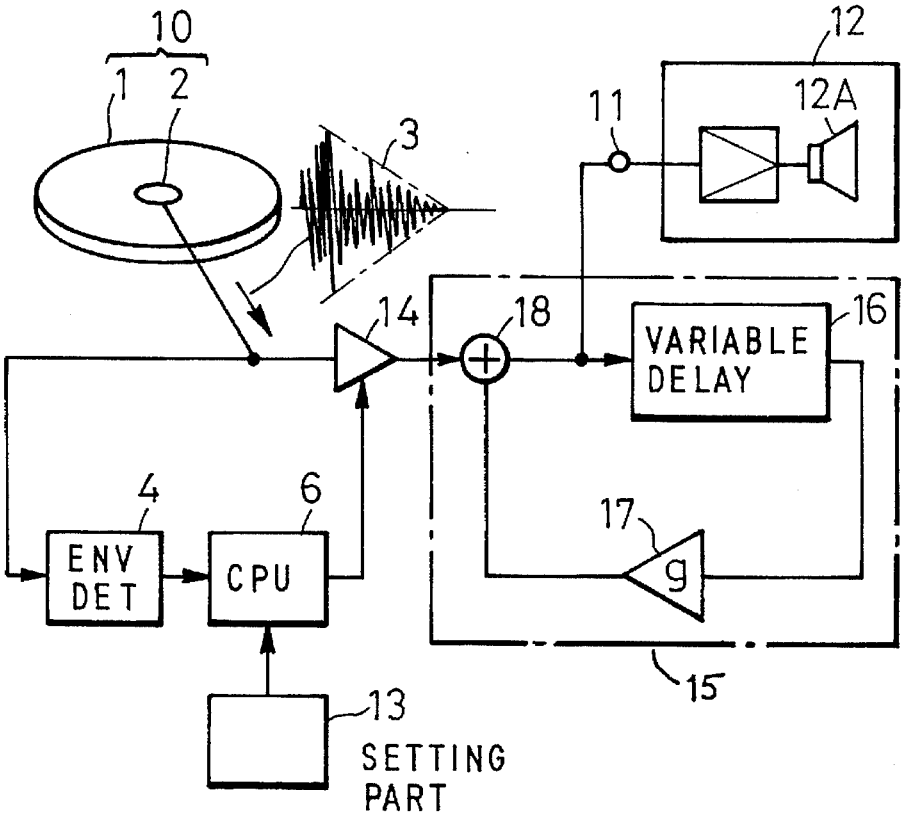
FIG. 2 is a connection diagram illustrating an embodiment of the present invention.

FIGS. 2 through 12 illustrate various embodiments of the present invention applied to electronic percussion instruments. In the embodiments described hereinafter the principal part of any electronic musical instrument may be formed by either an analog or digital circuit, and even in the case of using the digital circuit structure, neither of A-D and D-A converters is shown. FIG. 2 illustrates a basic embodiment of the present invention. Reference numeral 1 denotes a natural mechanical vibrator, i.e., a pad and 2 a vibration sensor attached thereto. The pad 1 and the sensor 2 constitute a signal source 10. An impulse or shock wave signal 3 from the sensor 2 is applied to a multiplier 14 which forms a gate, and as in the case of FIG. 1, the signal 3 is also fed to an envelope detector 4, wherein its envelope is detected, and the envelope signal is provided to a CPU 6. When supplied with the envelope signal, the CPU 6 generates a trigger signal such as a rectangular wave signal which has a fixed width preset by a setting part 13, starting at the rise of the envelope signal, for instance, or a triangular wave or ramp signal which decays at a rate preset by the setting part 13, also starting at the rise of the envelope signal. The trigger signal thus obtained is applied to the multiplier 14, wherein it is multiplied by the shock wave signal 3. By this, the shock wave signal 3 is cut out for a fixed length of its leading portion, or the waveform of the shock wave signal 3 is limited so that it decays to substantially zero within a predetermined period of time. The multiplied output is applied to a resonance circuit 15.

The electronic percussion instrument according to the present invention has a construction in which an arbitrary one of frequency components contained in the shock wave signal 3 available from the sensor 2 is extracted to produce a musical sound intended to obtain. To this end, in this embodiment the shock wave signal 3 from the sensor 2 is applied to the resonance circuit 15. In the actual electronic musical instrument embodying the present invention, the resonance circuit 15 is so constructed as to contain a number of resonance frequencies which are non-integral multiples relative to one another. In this embodiment, however, with a view to facilitating a better understanding of the principle of operation of the invention, the resonance circuit 15 is shown to be formed by a feedback loop which is made up of a variable delay 16, a variable gain amplifier 17 for amplifying the delayed signal from the variable delay 16 and an adder 18 for adding the amplified signal to the original signal of the basic signal path, and the resonance circuit 15 has, as resonance frequencies, the fundamental frequency and frequencies which are its integral multiplies.

Figure 3:
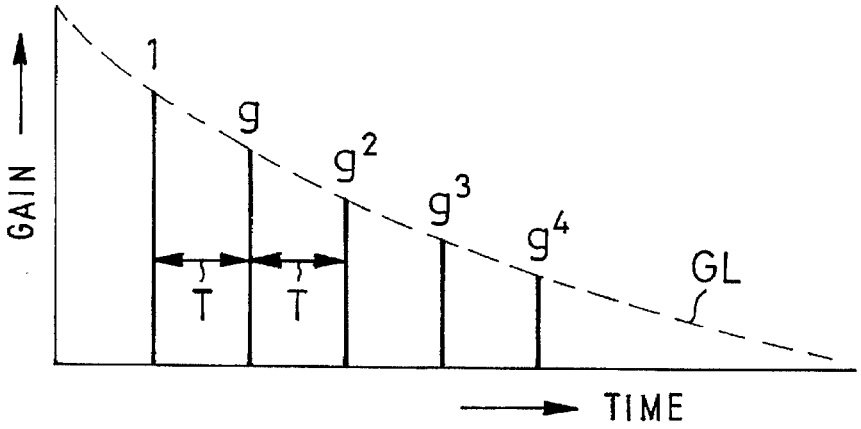
FIG. 3 is a graph showing the impulse response characteristic of a resonance circuit in FIG. 2.
Figure 4:
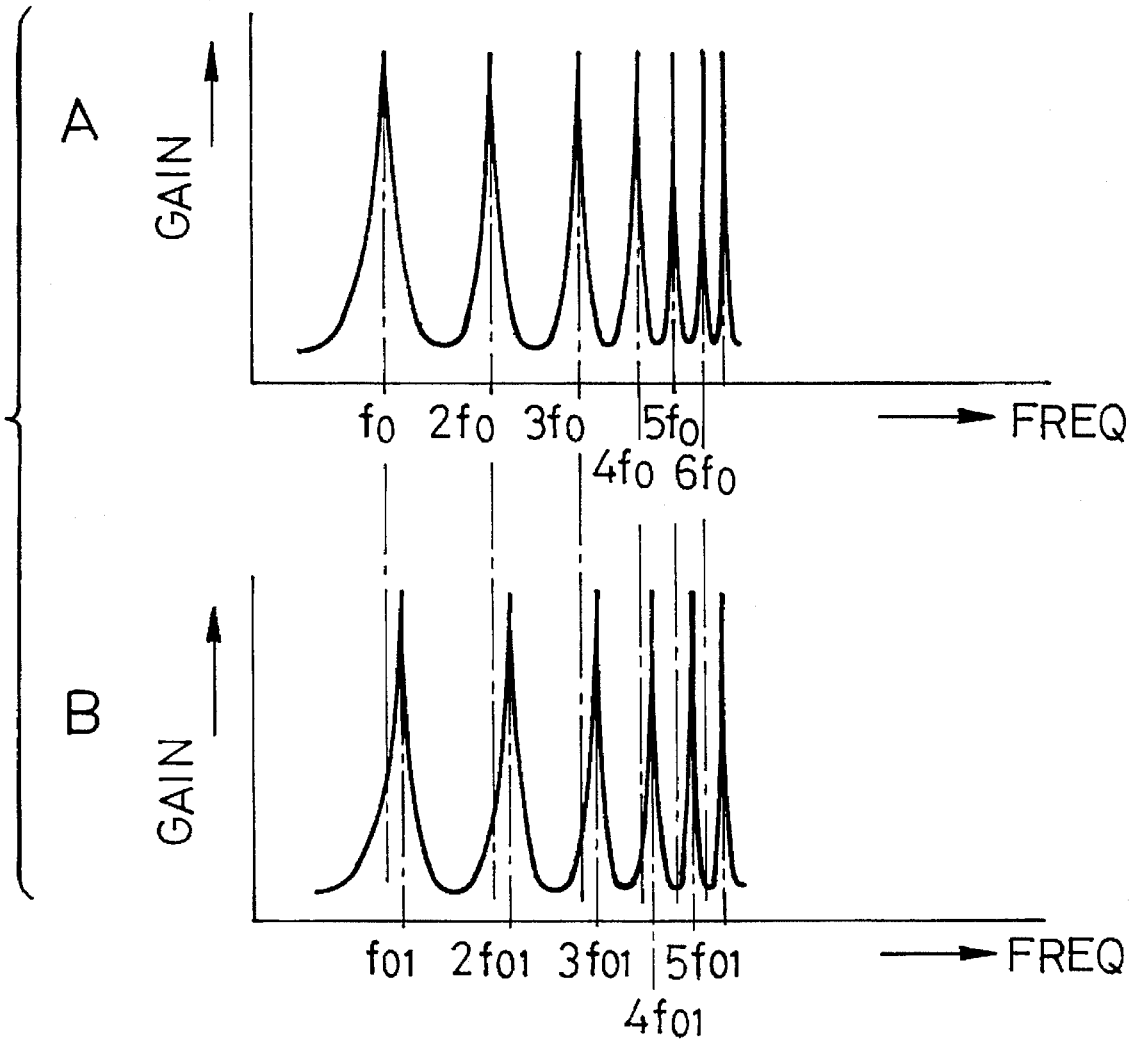
FIG. 4 is a graph showing the resonance characteristic of the resonance circuit in FIG. 2.

The resonance circuit 15 of such a construction is well-known as a comb filter of a basic characteristic which has resonance points at the fundamental frequency $f_0$ and frequencies of its integral multiples as shown in FIG. 4A. Letting the delay time of the variable delay 16 be represented by T, the impulse response of the resonance circuit has an envelope GL of a logarithm which is defined by the period of the delay time T and the gain g of the variable gain amplifier 17, as shown in FIG. 3. Consequently, when the shock wave signal 3 is applied to the resonance circuit 15, those frequency components of the shock wave signal 3 which match the resonance frequencies of the resonance circuit 15 are extracted as a resonance signal which has a note dependent on the period of the delay time T and the damping characteristics GL dependent on the gain g. The damping characteristics GL are very approximate to those of the acoustic instrument and vary with the magnitude of the amplitude of the input shock wave signal and its frequency components. If now the delay time T of the variable delay 16 is changed, the fundamental frequency $f_0$ of the resonance frequency will change to $f_{01}$ as shown in FIG. 4B and its harmonic frequencies similarly change to $2f_{01}$, $3f_{01}$, $4f_{01}$, . . . , and thus the resonance frequencies can be set to desired values. If the gain g of the variable gain amplifier 17 is changed, then the damping characteristics GL shown in FIG. 3 changes, and hence the decay time can be set. The delay time d of the variable delay 16 and the gain g of the variable gain amplifier 17 are both controlled by the CPU 6 in accordance with values preset in the setting part 13.

By connecting an amplifier/speaker system 12 at a desired circuit point in the loop forming the resonance circuit 15, it is possible to re-create from the amp/speaker system 12 an electronic musical instrument sound of the signal which resonates in the resonance circuit 15. While in this example the signal is taken out from between the adder 18 and the variable delay 16 and the sound of the signal circulating through the loop is produced from the amp/speaker system 12, the signal may also be taken out at any circuit point of the loop.

With the construction of the above-described embodiment, those frequency components contained in the shock wave signal 3 from the signal source 10 which agree with the resonance frequencies of the resonance circuit 15 are taken out. By setting the resonance frequencies and decay time of the resonance circuit 15 to proper values, it is possible to re-create electronic musical instrument sounds of various timbres. In the case of changing the frequency spectrum contained in the shock wave signal 3 from the vibration sensor 2 by striking the pad 1 with a stick at a different position, striking the pad 1 while pressing it with a hand, or striking the pad 1 with a hand, the spectrum of the signal in the resonance circuit 15 also changes accordingly, permitting a real-time change of the timbre. This provides an advantage that a change in the timbre intended by the player can be made.

Figure 5:
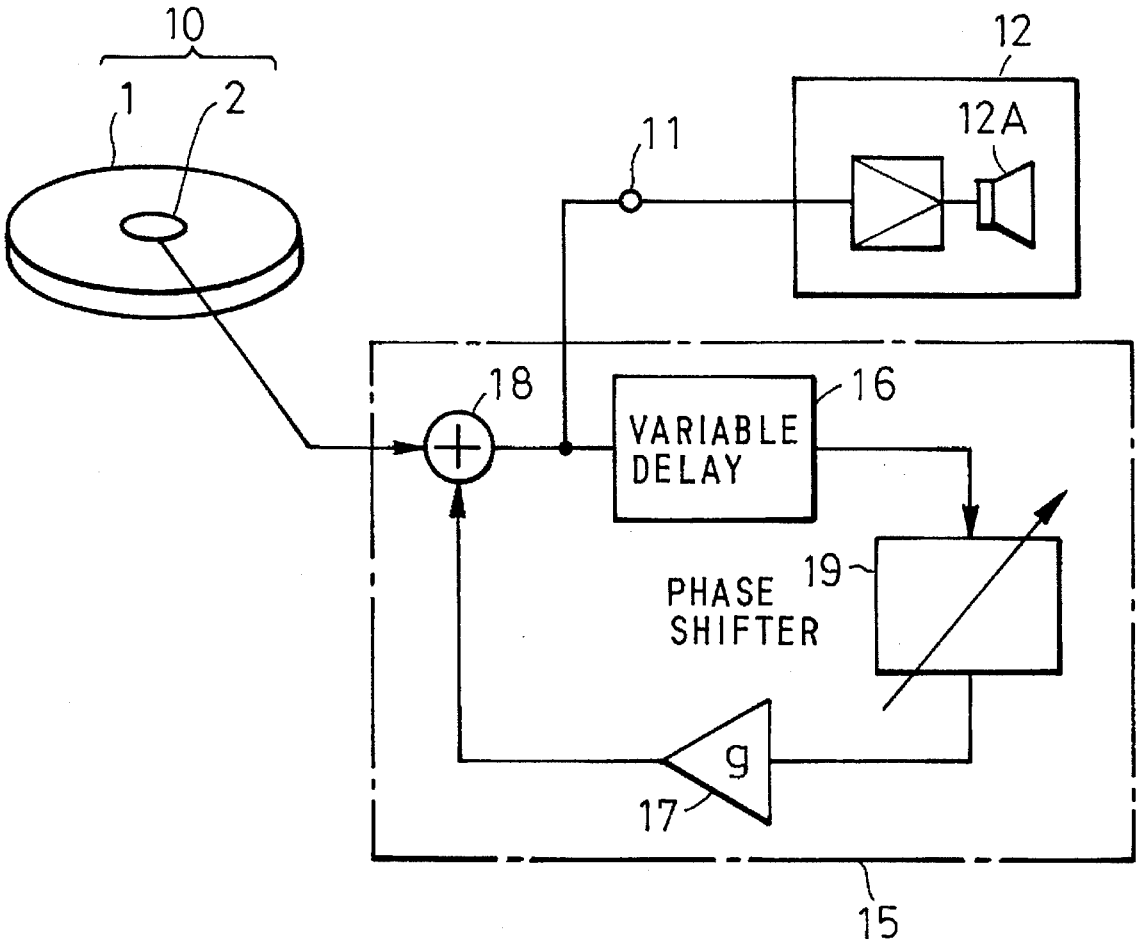
FIG. 5 is a connection diagram for explaining a modified form of the present invention.

FIG. 5 illustrates a modified form of the FIG. 2 embodiment. In the drawings for explaining embodiments of the invention described hereafter, the envelope detector 4, the CPU 6, the setting part 13 and the multiplier 14 are omitted for the sake of brevity. The embodiment of FIG. 5 is shown to have a variable phase shifter 19 inserted in the loop forming the resonance circuit 15. The phase shifter 19 may be an all-pass filter. The all-pass filter has a flat frequency characteristic but has a characteristic which changes the phase of the input signal thereto. By changing the phase of the signal with the all-pass filter 19 in accordance with its frequency, the resonance frequencies $f_0$, $2f_0$, $3f_0$, . . . and $f_{01}$, $2f_{01}$, $3f_{01}$, . . . shown in FIGS. 4A and 4B can be brought into a fractional-multiple relationship to one another, that is, the harmonic structure can be changed. Thus, the timbre can be controlled by controlling the phase of the variable phase shifter 19—this allows ease in simulating sounds of percussion instruments (metallic sounds, in particular) which have sounds of fractional-multiple harmonic frequencies. Incidentally, the damping characteristic in the high-frequency region can be simulated by use of a low-pass filter in place of the phase shifter 19. It is also possible to connect the low-pass filter and the phase shifter in series in the closed loop.

Figure 6:
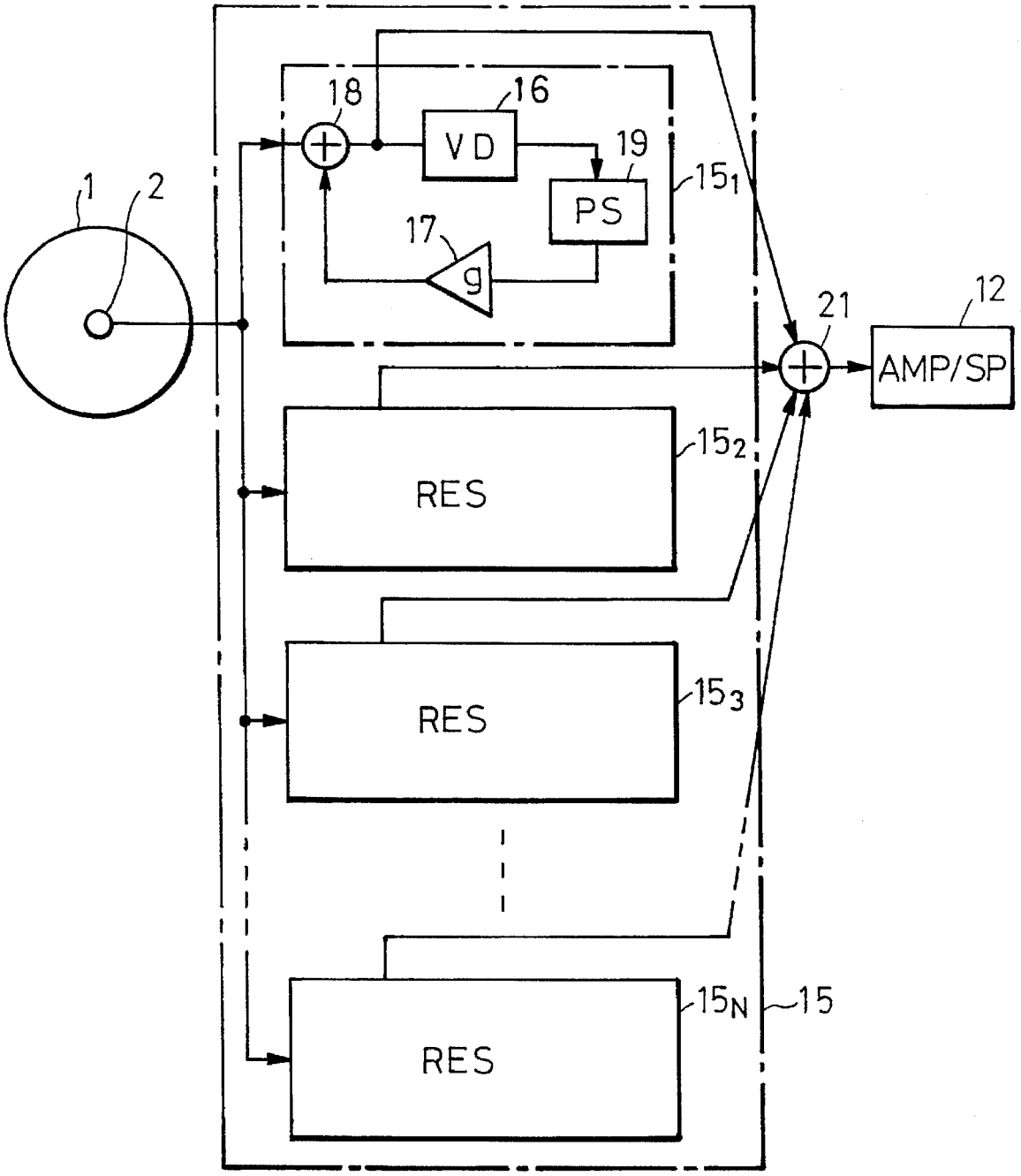
FIG. 6 is a connection diagram for explaining another modification of the present invention.

FIG. 6 illustrates another modification of the electronic musical instrument according to the present invention. In this embodiment a plurality of resonance circuits $15_1$ through $15_N$, which are identical with the resonance circuit 15 in the FIG. 2 or 5 embodiment, are provided in parallel to obtain a plurality of resonance signals so that resonance frequencies of the above-mentioned fractional-multiple relationship can easily be obtained. The resonance signals available from the resonance circuits $15_1$ to $15_N$ are mixed by a mixer 21 and the mixed output is applied to the amplifier/speaker system 12. In this embodiment, the delay amount of the variable delay 16 and/or the phase shift amount of the phase shifter 19 are properly selected to make the resonance frequencies of the resonance circuits $15_1$ to $15_N$ to have the non-integral-multiple relationship relative to one another, by which it is possible to take out of the resonance circuits frequency components which are suited to percussion sounds.

Figure 7:
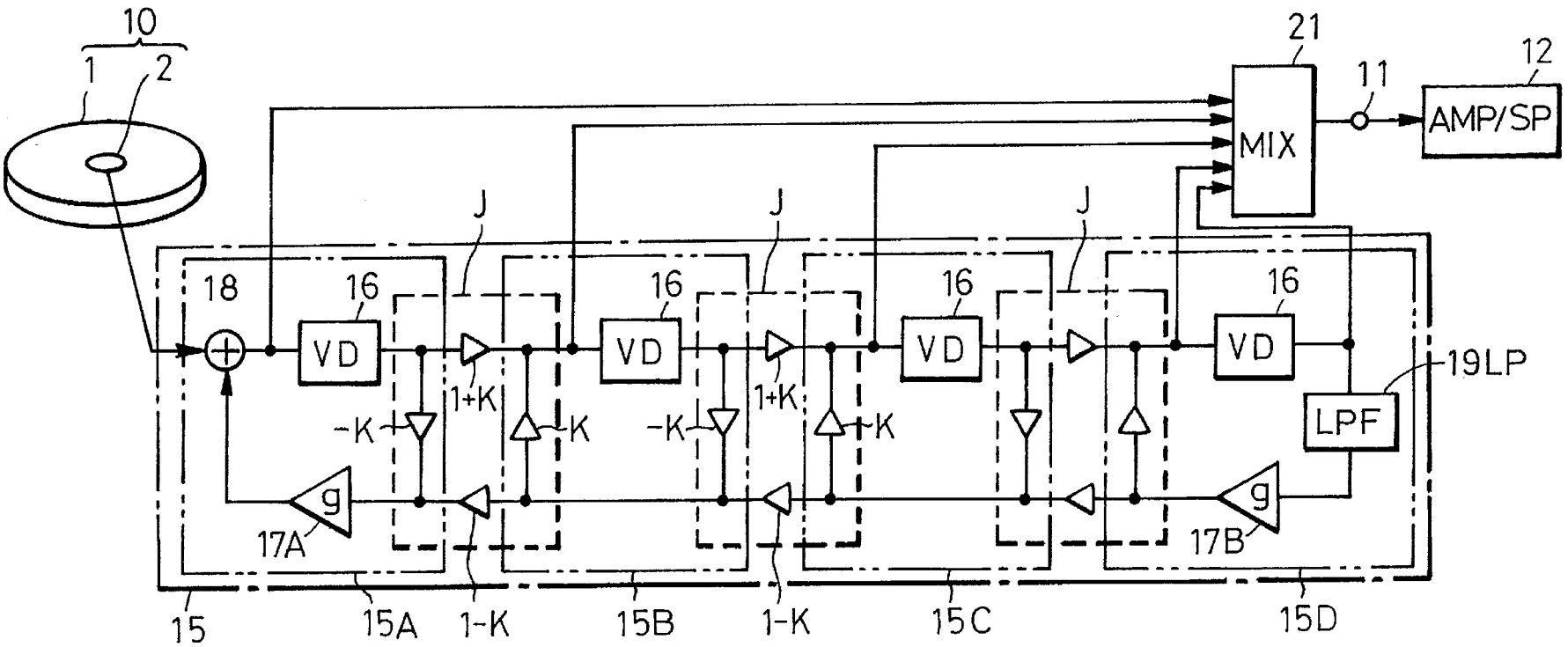
FIG. 7 is a connection diagram illustrating still another modified form of the present invention.

FIG. 7 illustrates another embodiment of the invention which employs another example of the resonance circuit capable of providing resonance frequencies of the non-integral-multiple relationship. In this embodiment the resonance circuit 15 is formed by a plurality of delay circuits 15A through 15D each having a variable delay 16 and connected via junctions J. The output of the variable delay 16 of each delay circuit stage is connected via the junction J to the input of that stage to form a feedback loop and is also connected to the feedback loop of the delay circuit of the preceding stage. The cascade connection of the delay circuits 15A to 15D form a well-known filter which imitates an acoustic pipe whose diameter changes stepwise at a plurality of positions. The coupling coefficient K of the junction J is well-known as a reflection coefficient by a no-loss acoustic pipe simulation. The reflection coefficient K is a reflection coefficient at each diameter changing point of the acoustic pipe. In this example the output of the variable delay 16 of the last stage is fed back to its input via a low-pass filter 19LP and a variable gain amplifier 17B.

The outputs from the variable delays 16 of all the stages are fed back to the adder 18 of the first stage via a variable gain amplifier 17A. In consequence, the signal at any point in the resonance circuit 15 has a frequency spectrum influenced by the delay circuits 15A to 15D. Only one such a signal may be taken out and output as a musical sound signal of the electronic musical instrument, but in this embodiment signals at the inputs of the respective variable delays 16 are taken out and combined by a mixer 21 at a desired ratio into a musical sound signal of the instrument, which is provided to a terminal 11. By setting the delay time of each variable delay 16, the gains of the variable gain amplifiers 17A and 17B and the characteristic of the low-pass filter 19LP that simulates the high-frequency region damping characteristic of the acoustic pipe, it is possible to obtain a musical sound signal of the electronic percussion instrument which has a desired frequency characteristic.

Figure 8A:
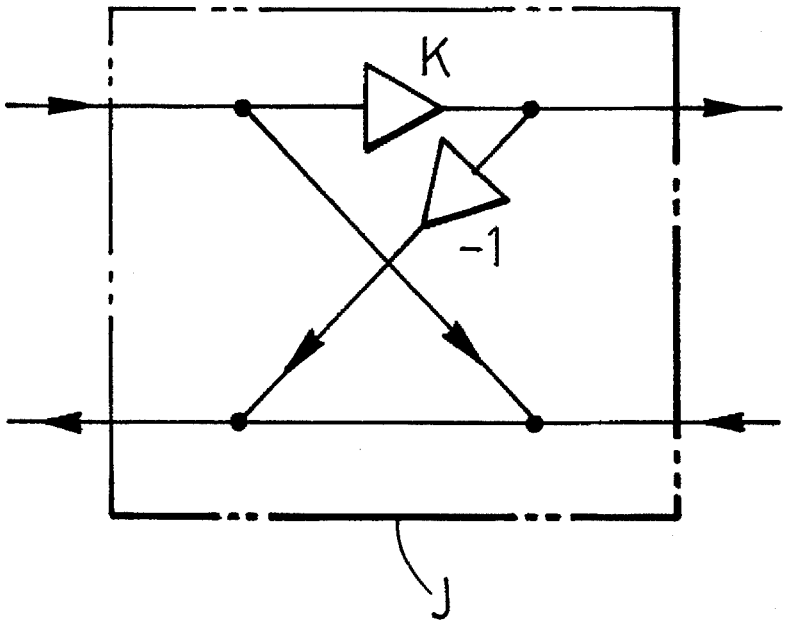
FIG. 8A is a diagram showing another example of the construction of a junction.
Figure 8B:
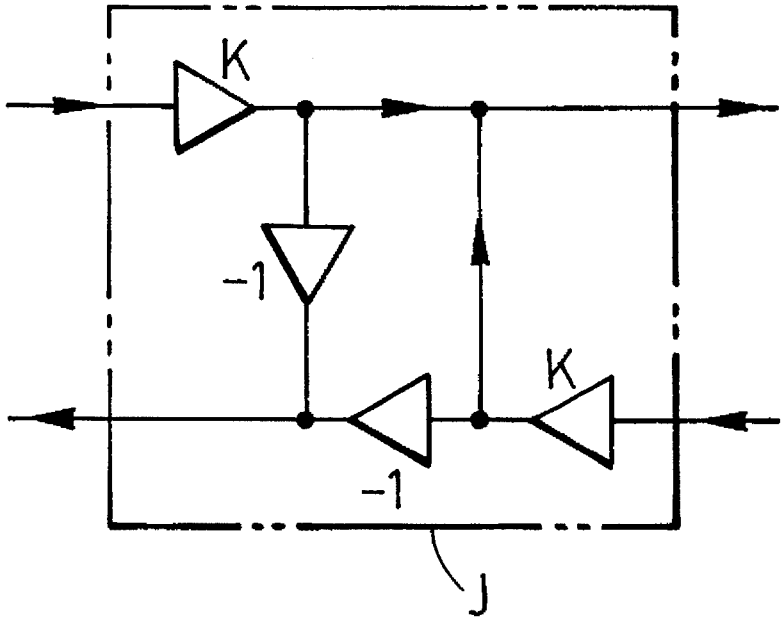
FIG. 8B is a diagram showing another example of the junction.

In the above embodiment the junction J is a square connection type one but it is not limited specifically thereto and other known junctions such as shown in FIGS. 8A and 8B may also be used. Furthermore, while in the above embodiment the resonance circuit 15 is shown to be formed by one cascade connection of variable delay circuits through use of the junctions J, a plurality of cascade-connected delay circuits 15B and 15C may also be connected via a multi-junction JM to the termination of a delay circuit 15A formed by a plurality of variable delays which are cascade-connected using the junction J as shown in FIG. 9.

Figure 10:
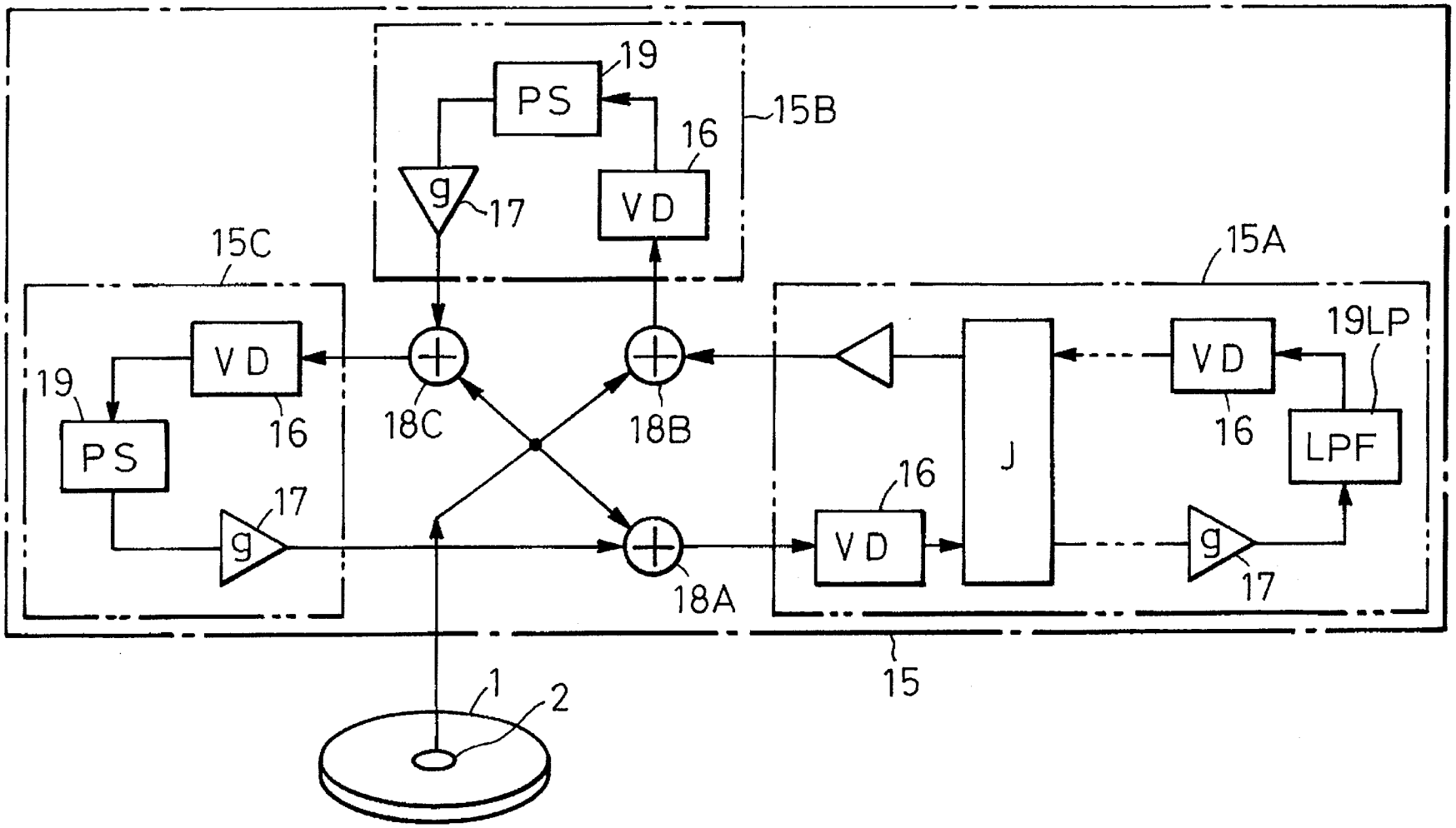
FIG. 10 is a block diagram illustrating an embodiment of the present invention which employs another modified resonance circuit.

FIG. 10 illustrates another example of the resonance circuit 15 which has a construction wherein a plurality of delay circuits 15A, 15B and 15C have their input and output terminals connected to a plurality of (three in this case) adders 18A, 18B and 18C, respectively. In this example the delay circuit 15A is formed by connecting a plurality of variable delays 16 in cascade through a junction J and the termination is fed back via the low-pass filter 19LP as in the case of FIG. 7. The delay circuits 15B and 15C each have one stage of variable delay 16 and the delay signal is fed back via the variable phase shifter 19. The shock wave signal 3 from the signal source 10 is applied to the adders 18A, 18B and 18C in common to them but a signal that is input from the adder, for instance, 18A into the corresponding delay circuit 15A passes through the other delay circuits 15B and 15C counterclockwise in FIG. 10 and is then fed back to the adder 18A, and thus the resonance circuit is formed.

Figure 9:
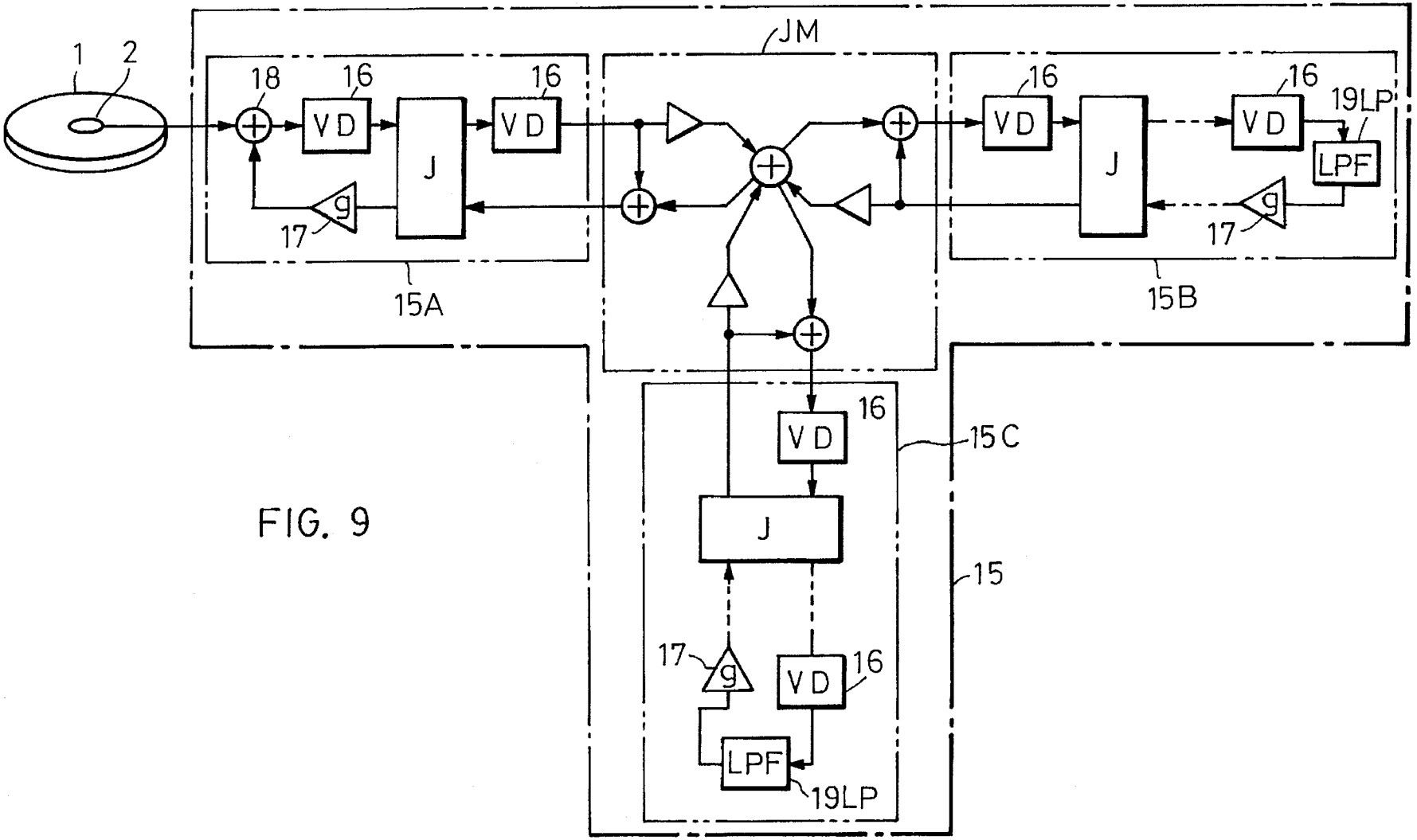
FIG. 9 is a block diagram illustrating an embodiment of the present invention which employs a modified resonance circuit.

In either of the embodiments of FIGS. 9 and 10, the sound signal of the electronic musical instrument can be produced by combining an arbitrary number of signals taken out at arbitrary number of different circuit points in the resonance circuit 15. As mentioned above, various constructions can be used for the resonance circuit 15 and the circuit 15 is constructed to have desired characteristics according to use.

Figure 11:
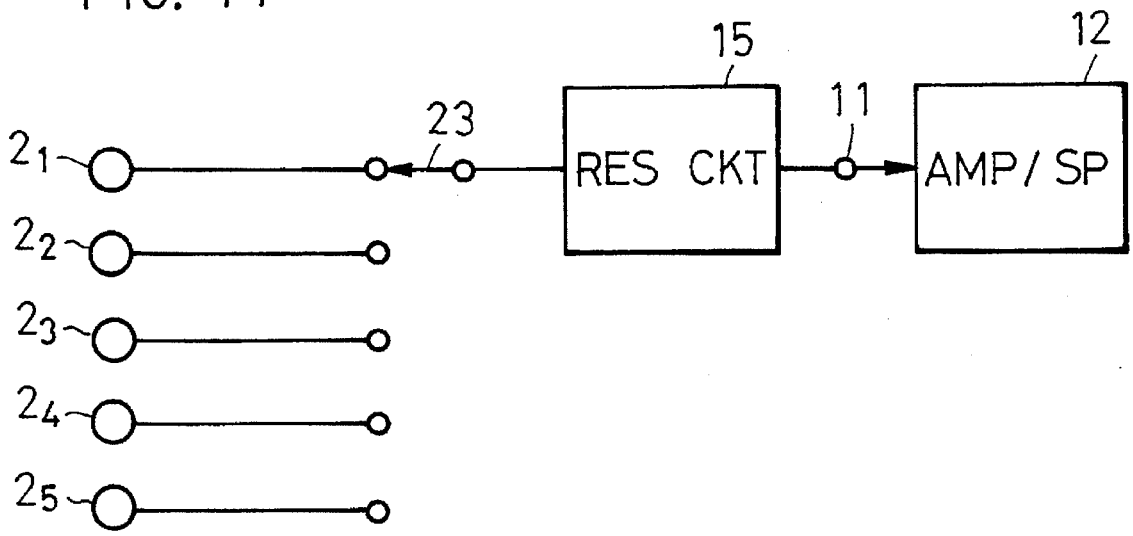
FIG. 11 is a connection diagram for explaining another modified form of the present invention.
Figure 12:
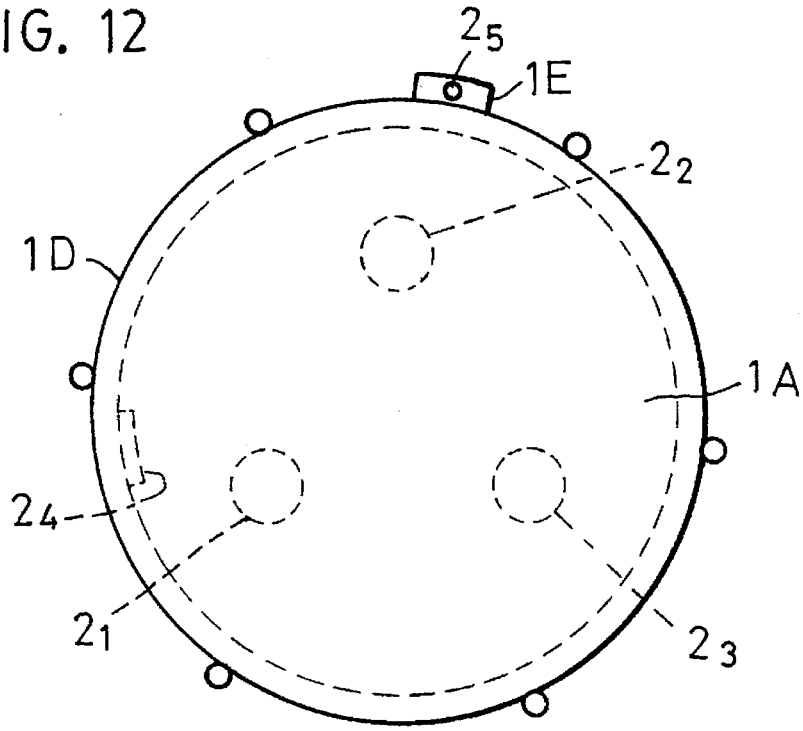
FIG. 12 is a sectional view for explaining the construction of the principal part of the electronic percussion instrument according to the present invention.
Figure 13:
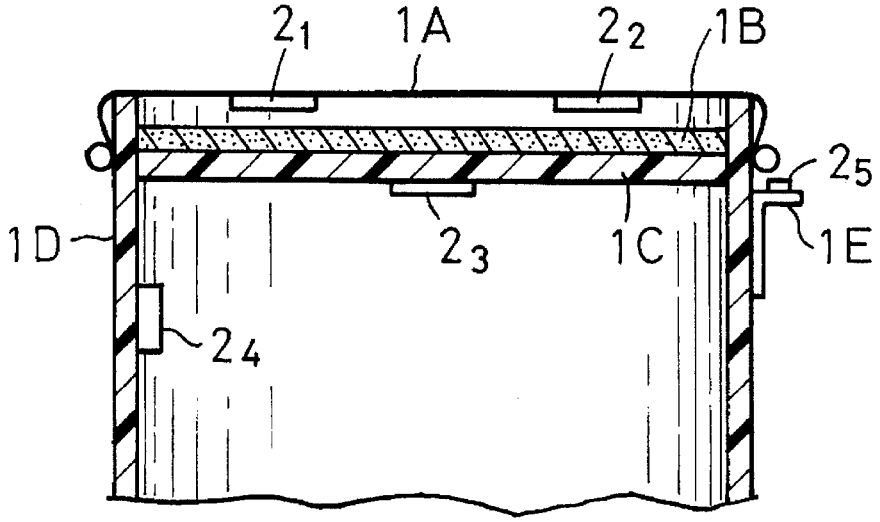
FIG. 13 is a side view for explaining the construction of a pad for use in the present invention.

FIG. 11 illustrates another embodiment of the electronic percussion instrument according to the present invention. This embodiment is intended to offer an electronic percussion instrument which permits setting a great variety of timbres or tone colors. To this end, in this embodiment a plurality of sensors $2_1$ through $2_5$ are attached to the pad 1 at different places as shown in FIGS. 12 and 13. The sensors $2_1$ and $2_2$ are attached to the back of the skin 1A forming the pad 1. The sensor $2_3$ is mounted on the back of a back board 1C of the pad 1, for instance. The back board 1B is covered all over its top surface with a sheet of rubber or similar elastic material 1B in adjacent but spaced relation to the skin 1A. The presence of the elastic material 1C suppresses chattering or like vibration of the back board 1C and facilitates the detection of the vibration of the skin 1A by the sensor $2_3$. The sensor $2_4$ is mounted on the inner peripheral surface of a drum 1D forming the pad 1. The sensor $2_5$ is secured to a metal fitting 1E attached to the outside of the drum 1D.

With such a construction, it is possible to generate shock wave signals of different frequency components at different positions even on the same pad 1. In the embodiment of FIG. 11 one of such shock wave signals is selected by a select switch 23 and fed to the resonance circuit 15, from which a signal of frequency components resonant with its resonance frequencies is applied to the amplifier/speaker system 12. The resonance circuit 15 may be any of the aforementioned ones and various other resonance circuits.

With such an arrangement, it is possible to obtain percussion sounds of different timbres corresponding to the positions of the respective sensors $2_1$ to $2_5$, by selecting them with the select switch 23. By selecting the sensor $2_5$ mounted on the metal fitting 1E, in particular, a sound of a metal percussion instrument can be obtained.

Figure 14:
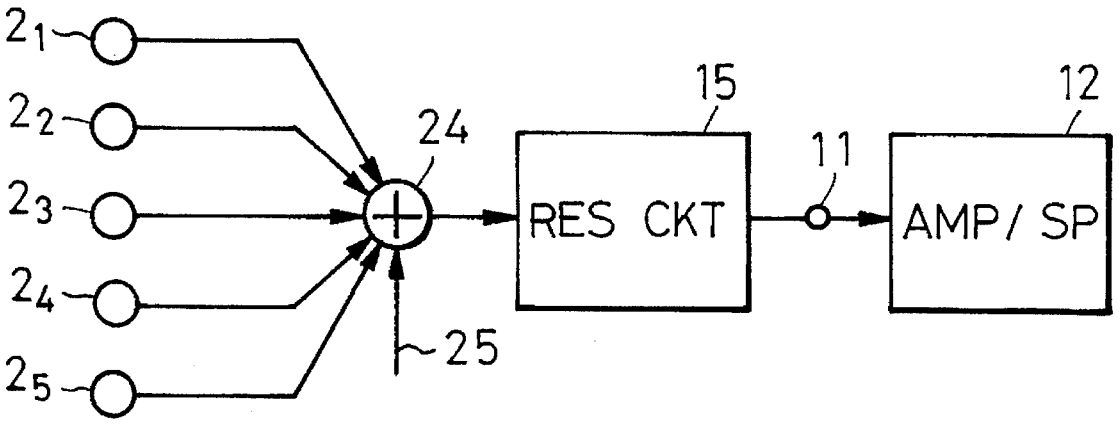
FIG. 14 is a connection diagram illustrating another embodiment of the present invention.

FIG. 14 illustrates a modified form of the FIG. 11 embodiment, in which the outputs from the sensors $2_1$ through $2_5$ attached to the pad 1 at different positions as referred to above in respect of FIGS. 12 and 13 are mixed or combined by a mixer 24. The mixing ratio is controlled by a control signal 25 and the mixed output is applied to the resonance circuit 15. The control signal 25 is provided from the CPU 6 on the basis of a value set in the setting part 13 depicted in FIG. 2.

Figure 15:
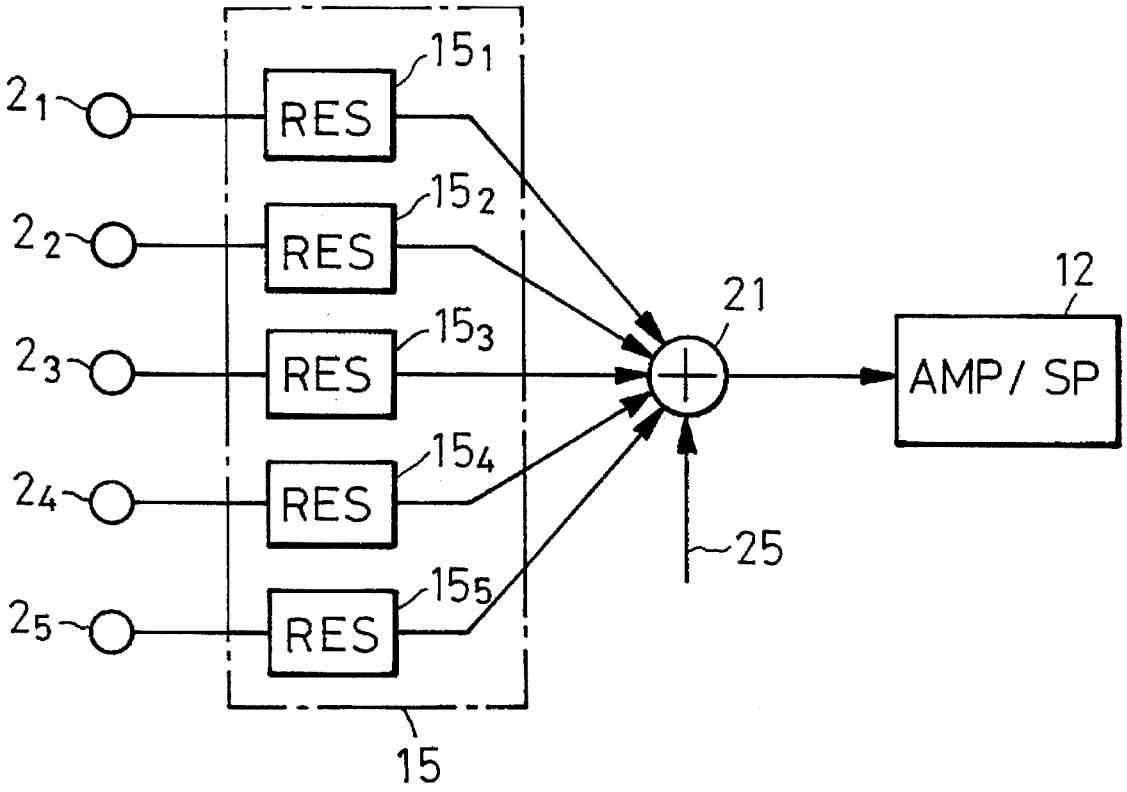
FIG. 15 is a sectional view for explaining another embodiment of the present invention.

In the embodiment of FIG. 15 the resonance circuit 15 is made up of a plurality of resonators $15_1$ through $15_5$ which are identical in construction with that shown in FIG. 2 or 5. The outputs from the sensors $2_1$ through $2_5$ are applied to the resonators $15_1$ through $15_5$, the outputs of which are mixed by a mixer 21 at a mixing ratio controlled by the control signal 25, and the mixed output is applied to the amplifier/speaker system 12. When the mixers 24 and 21 are used as shown in FIGS. 14 and 15, the timbre can be changed by controlling the mixing ratio of the mixers 24 and 21.

Incidentally, the amplifier/speaker system 12 is not requisite to the electronic musical instrument of the present invention, the scope of which extends to the output terminal 11 through which signals are applied to the amplifier/speaker system 12.

Figure 16:
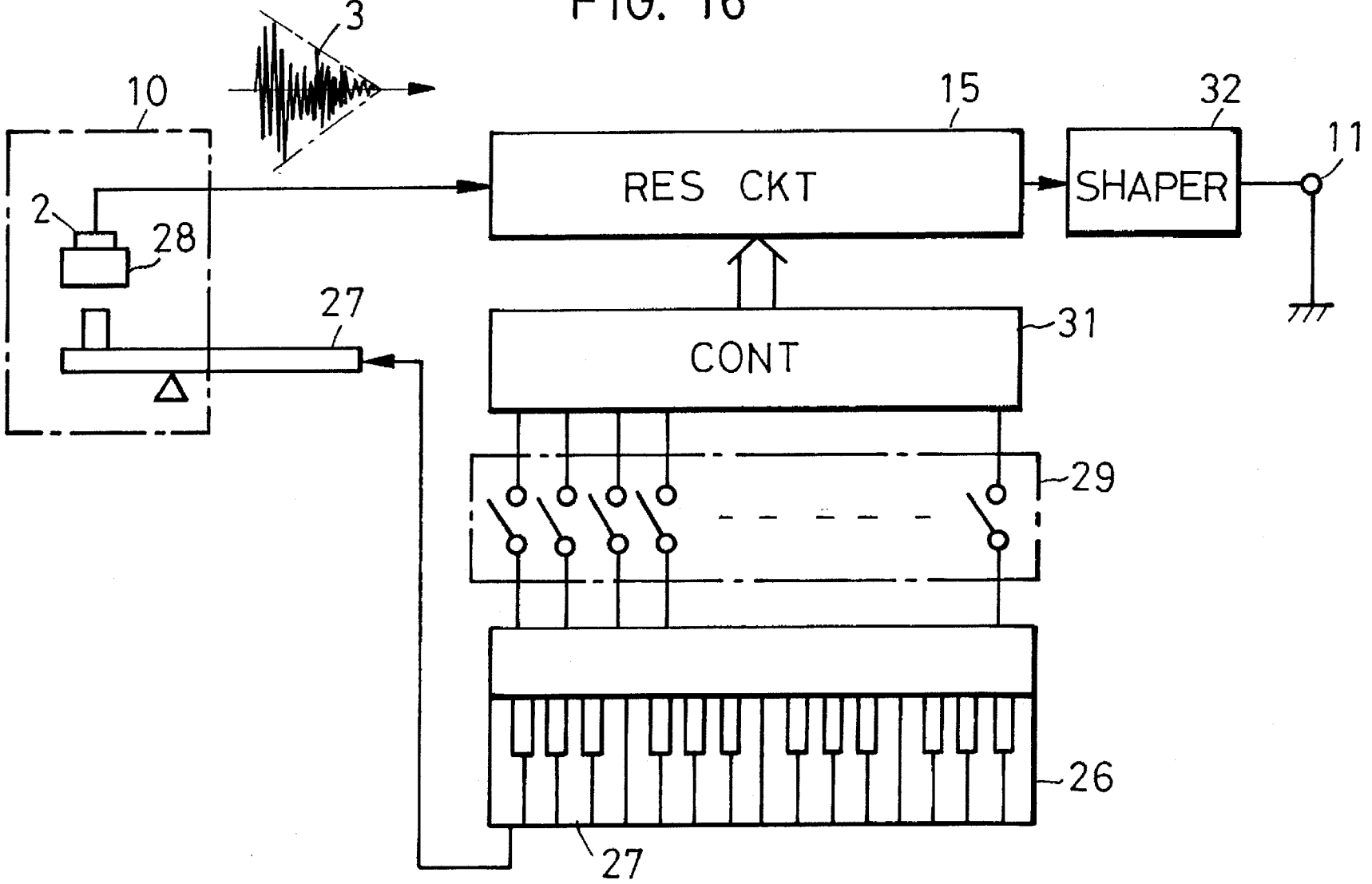
FIG. 16 is a system diagram showing the application of the invention to a keyboard instrument.

FIG. 16 illustrates another embodiment of the present invention applied to an electronic keyboard instrument. By hitting keys 27 of a note select unit (hereinafter referred to as a keyboard) 26, a shock is applied to a vibratory element 28 which forms the signal source 10. The vibratory element 28 is, for example, a metal or wooden bar which extends in the direction of arrangement of the keys 27 so that the vibratory element 28 can be hit by depressing any of the keys 27. The shock wave signal 3 from the sensor 2 is taken out and applied to the resonance circuit 15. A switch circuit 29 includes switches each provided in association with a corresponding one of keys 27 to detect its depression. Through the switches 29 a controller 31 reads which key or keys were actuated or depressed. The controller 31 sets a frequency or frequencies corresponding to one or more notes of the depressed key or keys to a resonance frequency or frequencies of the resonance circuit 15.

In the case where the resonance circuit 15 is such as shown in FIG. 2, the delay time of the variable delay 16 is set to a value which provides a resonance frequency intended to obtain, and a musical signal of a frequency corresponding to the note of the depressed key is obtained from the resonance circuit 15 and is then output via the terminal 11. In this instance, if a waveform shaping circuit 32 is connected between the resonance circuit 15 and the output terminal 11, then the waveform of the musical signal available from the resonance circuit 15 could be shaped into the waveform of a sound of a desired musical instrument such as a piano, guitar, wind instrument, percussion instrument or the like.

Figure 17:
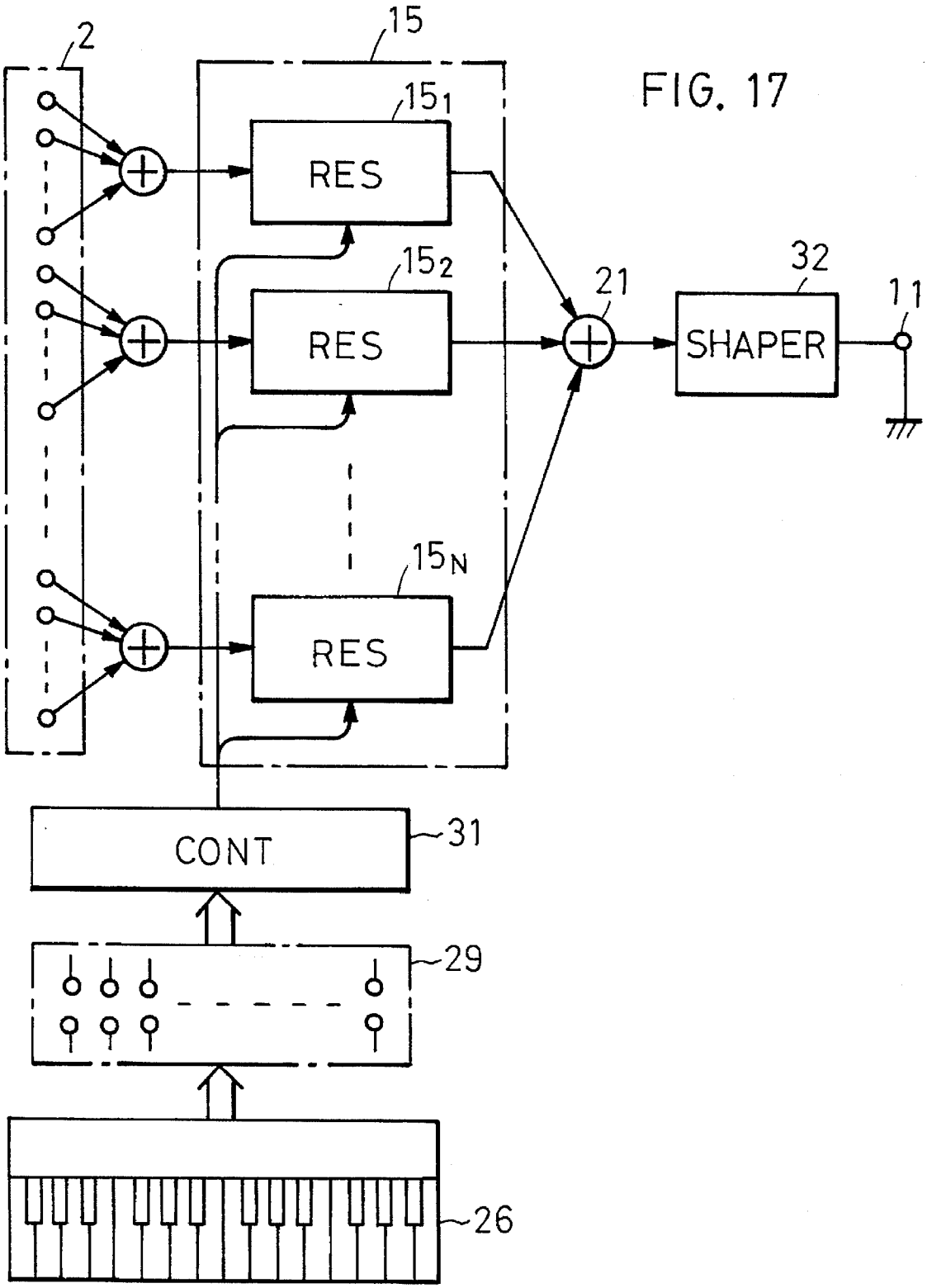
FIG. 17 is a connection diagram for explaining the electrical construction of the embodiment depicted in FIG. 15.

In the embodiment of FIG. 16 the sensor 2 may be provided corresponding to each or several keys 27 of the keyboard 26. The resonance circuit 15 comprises, for example, a plurality of resonators $15_1$ through $15_N$ as depicted in FIG. 17 and any one or more of the resonators are selected corresponding to a depressed one or more of the keys 27 and are controlled to resonate with the frequencies corresponding to the notes of the depressed keys. The resonance circuit 15 is made up of, for instance, 10 resonators so that even if 10 keys are simultaneously depressed, sounds of all the depressed keys can be produced at the same time. This technique has already been established as a key scan technique or the like in the field of electronic keyboard instruments, and the key scan feature can be added to the controller 31. Thus, those of the resonators which correspond to depressed keys can be selected by the key scan operation and controlled so that their resonance frequencies become resonance frequencies of the notes corresponding to the depressed keys.

Figure 18:
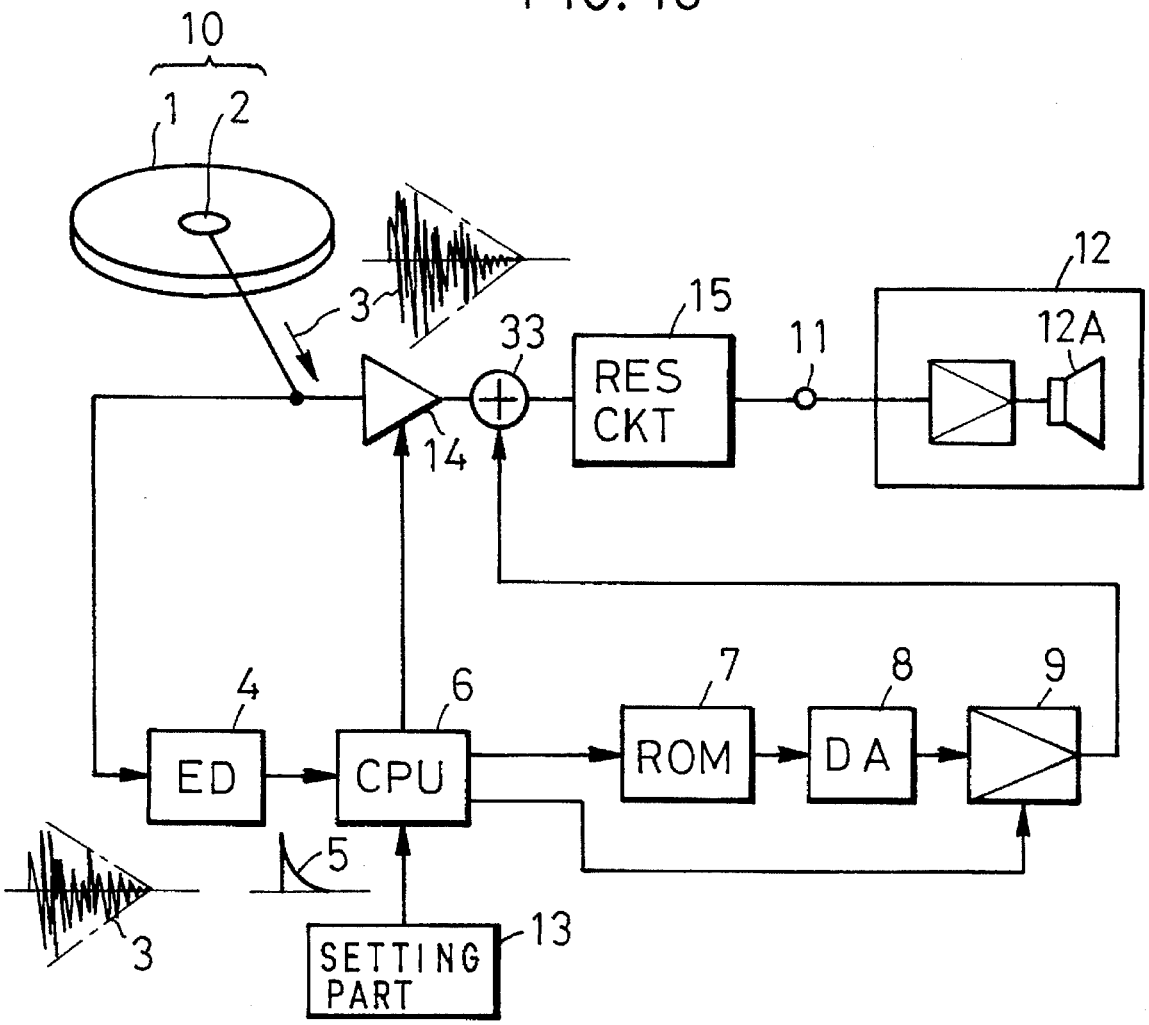
FIG. 18 is a diagram for explaining still another embodiment of the present invention.

FIG. 18 illustrates a further embodiment of the present invention, in which the resonance circuit 15 is supplied with the shock wave signal 3 from the signal source 10 and a signal from a pseudo sound source described previously in connection with the prior art example of FIG. 1. The shock wave signal 3 from the signal source 10 is applied to the envelope detector 4, from which the trigger signal 5 is taken out. The trigger signal 5 is fed to the CPU 6, which reads out waveform data of the note specified by the setting part 3 from the corresponding address area of the ROM 7. The sound data thus read out is converted by the D-A 8 converted into an analog signal, which is amplified, if necessary, and is applied via amplifier 9 to an adder 33 wherein it is added to the shock wave signal 3. The added output is provided to the resonance circuit 15. The signal that is applied from the amplifier 9 to the adder 33 may be a very short signal of the rise-up portion of a musical sound. The mixing ratio between this signal and the shock wave signal 3 can be set to a proper value by a suitable selection of the gain of the amplifier 9.

With such a construction as described above, the signal of the rise-up portion of an arbitrary sound read out of the ROM 7 as well as the shock wave signal 3 from the signal source 10 are applied to the resonance circuit 15, and hence a signal of resonance frequency components can be generated. Consequently, it is possible to produce a signal of a timbre which cannot be reproduced with the shock wave signal 3. Since data of various musical sounds can be prepared in the ROM 7, many kinds of percussion sounds can be reproduced. By applying this system to the keyboard instrument described above with respect to FIG. 16 or 17, a great variety of timbres can be obtained.

As described above, according to the present invention, the shock that is applied to natural mechanical the vibratory element is converted into an electric impulse signal, from which a signal of components resonant with the resonance frequencies of the resonance circuit is extracted for use as a musical signal of the electronic musical instrument; hence, the loudness and timbre of the musical sound can be expressed according to the manner in which the shock is applied to the vibratory element. In the case where the vibratory element (i.e. the pad) is outside of the musical instrument as in the case of a percussion instrument, timbres of sounds can be changed by hitting the pad while pressing it with a hand or changing the hitting position, and thus the musical sounds that the player intends to produce can easily be expressed. Incidentally, the resonance circuit mentioned above can be formed by either an analog circuit or a combination of a digital signal processor and a memory, for instance. It is evident that the resonance circuit may also be formed by mere band-pass filters which extract desired frequency components.

In the embodiments described above, it is possible to use various natural mechanical vibratory elements such as the aforementioned pads, strings of stringed instruments and so forth.

It will be apparent that many modifications and variations may be effected without departing from the scope of the novel concepts of the present invention.

What is claimed is:

1. An electronic musical instrument adapted to permit changes in timbre, comprising:

signal source means including at least one natural mechanical vibratory means which vibrates to produce a plurality of frequency components over a wide frequency band when a shock is applied to said vibratory means by a person using the musical instrument, and at least one vibration sensor means which detects the vibration of said vibratory means and converts said frequency components into an electric shock signal having characteristics dependent upon the nature of the shock applied to said vibratory means by the person using the musical instrument; and resonance circuit means which is supplied with said electric shock signal from said signal source means and resonates with selected ones of the frequency components in said electric shock signal to generate a resonance signal;

said resonance signal from said resonance circuit means being output as a sound signal of said electronic musical instrument.

2. The electronic musical instrument of claim 1, wherein said resonance circuit means includes resonance frequency control means for setting its resonance frequencies to desired frequencies.

3. The electronic musical instrument of claim 2, wherein said resonance circuit means includes decay time control means for controlling the decay time of its resonance.

4. The electronic musical instrument of claim 1, wherein said resonance circuit means includes: a plurality of resonance circuits which are supplied with said electric shock signal from said signal source means and resonate with desired frequency components contained in said electric shock signal to produce resonance signals, respectively; frequency setting means for setting the resonance frequencies of said plurality of resonance circuits to desired frequencies; and combining means for combining the resonance signals from said plurality of resonance circuits into said sound signal of said electronic musical instrument.

5. The electronic musical instrument of claim 4, wherein said resonance circuit means includes decay time control means for controlling the decay time of the resonance of each of said resonance circuits.

6. The electronic musical instrument of claim 1, wherein said resonance circuit means includes a plurality of variable delay means sequentially connected in cascade via predetermined junctions, said electric shock signal is input into said variable delay means at one end of said cascade connection, each stage of said cascade connection includes feedback loop means whereby the output of said variable delay means of said each stage is fed back to the input of said variable delay means and to the feedback loop means of the preceding stage of said cascade connection via said junctions of said each stage, and said sound signal of said electronic musical instrument is output on the basis of a signal taken out from at least one circuit point in said resonance circuit means.

7. The electronic musical instrument of claim 1, wherein said vibration sensor means includes a plurality of vibration sensors attached to said vibratory means at different positions, and select switch means which selectively applies the output signals from said plurality of vibration sensors to said resonance circuit means.

8. The electronic musical instrument of claim 1, wherein said vibration sensor means includes a plurality of vibration sensors attached to said vibratory means at different positions, and combining means for combining the output signals from said plurality of vibration sensors at a desired ratio into said electric shock signal to be supplied to said resonance circuit means.

9. The electronic musical instrument of claim 1, wherein said resonance circuit means includes adder means which is supplied at the one input with said electric shock signal, delay means for delaying the output signal from said adder means, and amplifier means for amplifying the delayed signal from said delay means, the output of said amplifier means being connected to the other input of said adder means to form a closed loop.

10. The electronic musical instrument of claim 9, wherein said delay means is variable delay means and forms resonance frequency setting means for variably setting the resonance frequencies of said resonance circuit means, and said amplifier means is a variable gain amplifier and forms decay time control means for controlling the decay time of said resonance signal.

11. The electronic musical instrument of claim 9, wherein said closed loop includes variable phase shifter means.

12. The electronic musical instrument of claim 1, wherein a plurality of said resonance circuit means are provided to simultaneously output a plurality of sound signals of said electronic musical instrument.

13. The electronic musical instrument of claim 1, which further comprises note select means responsive to its actuation to output a note select signal and wherein the resonance frequencies of said resonance circuit means are controlled in accordance with said note select signal, whereby said sound signal output of said electronic musical instrument has frequencies corresponding to the notes selected by said note select means.

14. The electronic musical instrument of claim 12, which further comprises note select means responsive to its actuation to output note select signals and wherein the resonance frequencies of said plurality of resonance circuit means are controlled by said note select signals, making it possible to simultaneously output sound signals of said electronic musical instrument which have frequencies corresponding to the notes selected by said note select signals.

15. The electronic musical instrument of claim 14, wherein a plurality of said signal source means are provided corresponding to a plurality of sound ranges, said electric shock signals from said plurality of signal source means are applied to said plurality of resonance circuit means, and the resonance frequencies of said plurality of resonance circuit means are controlled by said note select means.

16. The electronic musical instrument of claim 1, which further comprises: trigger signal generating means for generating a trigger signal from said electric shock signal from said signal source means; storage means from which sound data is read out in response to said trigger signal; and combining means for combining said read-out sound data with said electric shock signal to be input into said resonance circuit means.

17. The electronic musical instrument of claim 1, wherein said resonance circuit means includes at least one delay circuit means including variable delay means which is supplied at its input with a signal corresponding to said electric shock signal and delays it for a desired period of time and a feedback loop through which a signal corresponding to the output of said variable delay means is fed back to the input of said variable delay means.

18. The electronic musical instrument of claim 17, wherein said delay circuit means has variable phase shifter means inserted in said feedback loop.

19. The electronic musical instrument of claim 17 or 18, wherein said delay circuit means has variable gain amplifier means inserted in said feedback loop.

20. The electronic musical instrument of claim 17 or 18, wherein said delay circuit means has low-pass filter means inserted in said feedback loop.

* * * * *